US009039388B2

(12) United States Patent
An et al.

(10) Patent No.: US 9,039,388 B2
(45) Date of Patent: May 26, 2015

(54) HERMETIC COMPRESSOR

(75) Inventors: Jaechan An, Changwon (KR); Keunju Lee, Changwon (KR); Hongseok Seo, Changwon (KR); Jeongmin Han, Changwon (KR); Jeonghun Kim, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 754 days.

(21) Appl. No.: 13/115,771

(22) Filed: May 25, 2011

(65) Prior Publication Data

US 2011/0293445 A1 Dec. 1, 2011

(30) Foreign Application Priority Data

May 31, 2010 (KR) ..... 10-2010-0051331

(51) Int. Cl.

| | |
|---|---|
| ***F04C 18/00*** | (2006.01) |
| ***F04C 23/00*** | (2006.01) |
| ***F01C 21/02*** | (2006.01) |
| *F04C 18/02* | (2006.01) |
| *F04C 18/356* | (2006.01) |

(52) U.S. Cl.

CPC ..... *F04C 23/008* (2013.01); *F01C 21/02* (2013.01); *F04C 18/0215* (2013.01); *F04C 18/3564* (2013.01); *F04C 2230/602* (2013.01)

(58) Field of Classification Search

CPC ..... F04C 23/008; Y10S 417/902
USPC ..... 417/410.1, 410.3, 410.5, 423.12, 417/423.14, 902; 418/54
See application file for complete search history.

(56) References Cited

U.S. PATENT DOCUMENTS

| | | | | |
|---|---|---|---|---|
| 2,137,962 | A * | 11/1938 | Weiher | 417/363 |
| 3,104,051 | A * | 9/1963 | Henning et al. | 55/385.1 |
| 3,565,553 | A * | 2/1971 | Rinehart | 417/423.12 |
| 4,137,014 | A * | 1/1979 | Parker | 417/326 |
| 4,895,496 | A * | 1/1990 | Elson | 417/372 |
| 5,087,170 | A * | 2/1992 | Kousokabe et al. | 415/110 |
| 5,092,747 | A | 3/1992 | Irino | 417/312 |
| 5,340,287 | A * | 8/1994 | Kawahara et al. | 417/410.5 |
| 5,380,170 | A * | 1/1995 | Fain | 417/410.5 |
| 6,709,247 | B1 * | 3/2004 | Clendenin et al. | 418/55.1 |
| 8,419,286 | B2 * | 4/2013 | Han et al. | 384/371 |

FOREIGN PATENT DOCUMENTS

| | | |
|---|---|---|
| CN | 1712726 | 12/2005 |
| CN | 100465449 | 3/2009 |
| JP | H08291795 | 11/1996 |
| JP | 2008128035 | 6/2008 |
| JP | 2008208752 | 9/2008 |

OTHER PUBLICATIONS

Chinese Office Action issued in Application No. 201110148030.3, dated Jul. 10, 2013.

* cited by examiner

*Primary Examiner* — Peter J Bertheaud
(74) *Attorney, Agent, or Firm* — Ked & Associates, LLP

(57) ABSTRACT

A compressor has a rotational driver in a hermetic container, a rotational shaft coupled to the rotation driver, and a compression mechanism coupled to the rotational shaft to inhale and compress refrigerant. In addition, a first bearing fixed to the compression mechanism supports the rotational shaft, and a second bearing is separated from the first bearing on the rotational shaft. The gap between the shaft and the first bearing is set to control a gap between the shaft and the second bearing.

9 Claims, 4 Drawing Sheets

HERMETIC COMPRESSOR

CROSS-REFERENCE TO RELATED APPLICATIONS

Pursuant to 35 U.S.C. §119(a), this application claims the benefit of and right of priority to Korean Application No. 10-2010-0051331, filed on May 31, 2010, the contents of which are incorporated herein by reference.

BACKGROUND

1. Field

One or more embodiments described herein relate to a compressor.

2. Background

A hermetic compressor may be classified as a reciprocating type, a scroll type, or a vibration type. The reciprocating type and scroll type uses a rotational force of the drive motor, and the vibration type uses reciprocating motion of the drive motor for compression.

The drive motor of a compressor using rotational force is provided with a rotation shaft to transfer the rotational force to the compressor mechanism. For instance, the drive motor of the rotary type compressor (hereinafter, rotary compressor) may include a stator fixed to the hermetic container, a rotor inserted into the stator with a predetermined air gap to be rotated by interaction with the stator, and a rotation shaft combined with the rotor to transfer rotational force to the compressor mechanism.

The compressor mechanism may include a compressor mechanism combined with the rotation shaft to inhale, compress, and discharge refrigerant while rotating within a cylinder, and a plurality of bearing members supporting the compressor mechanism while at the same time forming a compression space together with the cylinder. The bearing members are arranged at a side of the drive motor to support the rotation shaft.

In recent years, a high-performance compressor has been introduced in which bearings are provided at both upper and lower ends of the rotation shaft, respectively, to minimize the vibration of the compressor.

In this manner, if bearings supporting the rotation shaft are added thereto, then a contact area between the bearings and the rotation shaft is increased, and such an increased contact area causes an increase of friction loss. In order to minimize friction loss, attempts have been made to enhance mechanical precision of each component of the compressor. However, this approach has drawbacks, not the least of which includes an increase in production cost.

DETAILED DESCRIPTION

Figure 1:
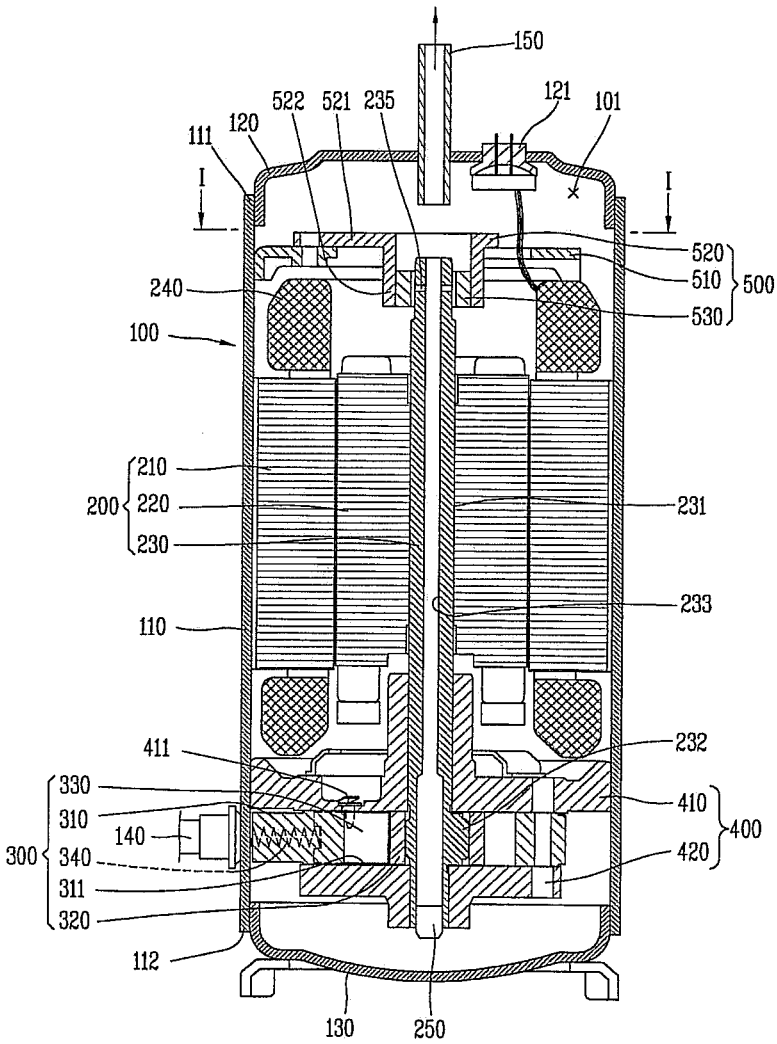
FIG. 1 shows one embodiment of a hermetic compressor.
Figure 2:
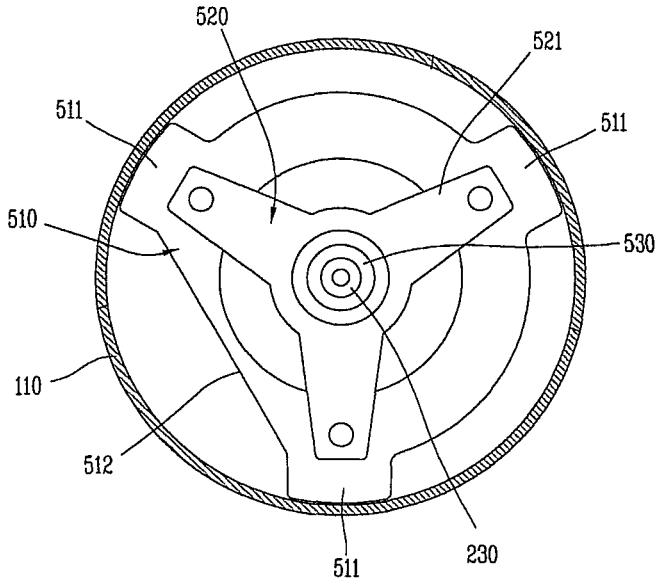
FIG. 2 shows a cross-sectional view taken along the line I-I in FIG. 1.

FIG. 1 is a longitudinal cross-sectional view of an inner portion of a rotary compressor according to one embodiment, and FIG. 2 is a cross-sectional view taken along the line I-I of FIG. 1. As shown, in the rotary compressor includes a drive motor 200 generating a driving force provided at an upper side of an inner space 101 of the hermetic container 100, and a compressor mechanism 300 compressing refrigerant based on power generated from the drive motor. The compressor mechanism is provided at a lower side of inner space 101 of a hermetic container 100. Also, a first bearing 400 and a second bearing 500 supporting a crankshaft 230 are provided at a lower side and an upper side of the drive motor 200, respectively.

The hermetic container 100 may include a container body 110 that includes drive motor 200 and compressor mechanism 300, an upper cap (hereinafter, a first cap) 120 covering an upper opening end (hereinafter, a first opening end) 111 of the container body 110, and a lower cap (hereinafter, a second cap) 130 covering a lower opening end (hereinafter, a second opening end) 112 of the container body 110.

The container body 110 may be formed in a cylindrical shape, a suction pipe 140 may be penetrated and combined with a circumferential surface of the lower portion of the container body 110, and the suction pipe is directly connected to a suction port (not shown) provided in a cylinder 310.

An edge of the first cap 120 may be bent to be welded and combined with a first opening end 111 of the container body 110. Furthermore, a discharge pipe 150 for guiding refrigerant discharged from the compressor mechanism 300 to an inner space 101 of the hermetic container 100 to a freezing cycle is penetrated and combined with a central portion of the first cap 120.

An edge of the second cap 130 may be bent to be welded and combined with a second opening end 112 of the container body 110.

The drive motor 200 may include a stator 210 shrink fitted and fixed to an inner circumferential surface of the hermetic container 100, a rotor 220 rotatably arranged at an inner portion of the execution controller 210, and a crankshaft 230 shrink fitted to the rotator 220 to transfer a rotational force of the drive motor 200 to the compressor mechanism 300 while being rotated therewith.

For the stator 210, a plurality of stator sheets may be laminated at a predetermined height, and a coil 240 is wound on the teeth provided at an inner circumferential surface thereof.

The rotor 220 may be arranged with a predetermined air gap on an inner circumferential surface of the stator 210 and the crankshaft 230 is inserted into a central portion thereof with a shrink fit coupling and combined to form an integral body.

The crankshaft 230 may include a shaft portion 231 combined with the rotor 220, and an eccentric portion 232 eccentrically formed at a lower end portion of the shaft portion 231 to be combined with a rolling piston which will be described later.

Furthermore, an oil passage 233 penetrates and is formed in an axial direction at an inner portion of the crankshaft 230 to suck up oil of the hermetic container 100. Furthermore, an oil through hole 235 communicating with the oil passage 233 may be formed at a portion facing the second bearing in an upper portion of the crankshaft 230. The oil through hole 235 will be described in greater detail later.

The compressor mechanism 300 may include a cylinder 310 provided within hermetic container 100, a rolling piston 320 rotatably combined with an eccentric portion 232 of crankshaft 230 to compress refrigerant while being revolved in a compression space (V1) of the cylinder 310, a vein 330 movably combined with the cylinder 310 in a radial direction such that a sealing surface at one side thereof to be brought into contact with an outer circumferential surface of the rolling piston 320 to partition a compression space (no reference numeral) of the cylinder 310 into a suction chamber and a discharge chamber, and a vein spring 340 formed of a compression spring to elastically support a rear side of the vein 330.

The cylinder 310 may be formed in a ring shape, a suction port (not shown) connected to the suction pipe is formed at a side of the cylinder 310, a vein slot 311 with which the vein 330 is slidably combined is formed at a circumferential-direction side of the suction port, and a discharge guide groove (not shown) communicated with a discharge port 411 provided in an upper bearing which will be described later is formed at a circumferential-direction side of the vein slot 311.

The first bearing 400 may include an upper bearing 410 welded and combined with the hermetic container 100 while covering an upper side of the cylinder 310 to support the crankshaft 230 in an axial and radial direction, and a lower bearing 420 welded and combined with the hermetic container 100 while covering an lower side of the cylinder 310 to support the crankshaft 230 in an axial and radial direction.

The second bearing 500 may include a frame 510 welded and combined with an inner circumferential surface of the hermetic container 100 at an upper side of the stator 210, and a housing 520 combined with the frame 510 to be rotatably combined with the crankshaft 230.

The frame 510 may be formed in a ring shape, and a fixed protrusion 511 protruded at a predetermined height to be welded to the container body 110 is formed on a circumferential surface thereof. The fixed protrusion 511 is formed to have a predetermined arc angle with an interval of 120 degrees approximately along a circumferential direction.

The housing 520 may be formed with support protrusions 521 with an interval of about 120 degrees to support the frame 510 at three points, a bearing protrusion 522 is formed to be protruded downward at a central portion of the support protrusions 521, thereby allowing an upper end of the crankshaft 230 to be inserted and supported. A bearing bush 530 may be combined or a ball bearing may be combined with the bearing protrusion 522. Reference numeral 250 is an oil feeder.

In operation, when power is applied to the stator 210 of the drive motor 200 to rotate the rotor 220, the crankshaft 230 is rotated while both ends thereof is supported by the first bearing 400 and the second bearing 500. Then, the crankshaft 230 transfers a rotational force of the drive motor 200 to the compressor mechanism 300, and the rolling piston 320 is eccentrically rotated in the compression space in the compressor mechanism 300. Then, the vein 330 compresses refrigerant while forming a compression space together with the rolling piston 320 to be discharged to an inner space 101 of the hermetic container 100.

While the crankshaft 230 is rotated at a high speed, the oil feeder 250 provided at a lower end pumps oil filled in an oil storage portion of the hermetic container 100, and the oil is sucked up through the oil passage 233 of the crankshaft 230 to lubricate each bearing surface. The sucked-up oil is supplied to the second bearing through the oil through hole 235.

The crankshaft 230 is fixed within the hermetic container 110 through the first bearing located at a lower portion thereof, and is located to be separated from the stator 210 with a predetermined gap. Thus, according to circumstances, the crankshaft may be disposed to be inclined with respect to a longitudinal direction of the hermetic container 110. Such an aspect is illustrated in FIG. 3.

Figure 3:
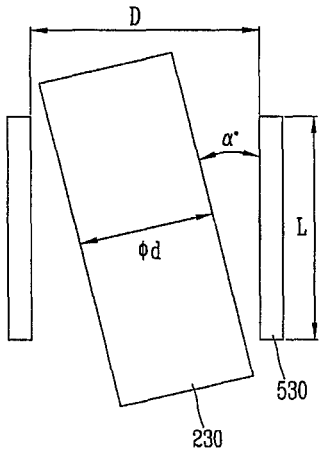
FIG. 3 shows how a rotation shaft may be inclined relative to a second bearing in accordance with one embodiment of a hermetic compressor.

Referring to FIG. 3, when an inner diameter of the bearing bush 530 facing the crankshaft 230 is D, and a diameter of the crankshaft 230 is d in the second bearing 500, a normal clearance C0 in case where the crankshaft 230 is located parallel to an inner wall surface of the bearing bush 530 is typically set to d/1000 (μm).

Here, the normal clearance implies a clearance at a typically set level without considering the inclination of the crankshaft. The normal clearance may be suitably set by taking a material of the bearing bush, a characteristic of the used lubricant, a size of the bearing and crankshaft, and the like into account, and a clearance set in the first bearing may be used as the normal clearance.

In other words, the first bearing is mounted on the compression mechanism, and the compression mechanism and the first bearing are centered to the hermetic container 110 at the same time during the assembly process and thus it is not affected even when the crankshaft is disposed to be inclined. As a result, for the first bearing, the inclination thereof may not be considered greatly significant.

However, as illustrated in FIG. 3, when the crankshaft 230 is disposed to be inclined at an inclination angle)($\alpha°$) within the bearing bush 530, the normal clearance is reduced at the one side thereof (left side in FIG. 3), and increased at the other side (right side in FIG. 3). As a result, the normal clearance is not maintained within an optimal range. In particular, there is a possibility that the crankshaft may be brought into contact with an inner surface of the bearing bush during rotation at the side of which the clearance is reduced. This may cause an increase of friction loss. Moreover, such a reduced amount of the clearance may increase with the length (L) of the bearing bush.

Furthermore, the crankshaft 230 is rotated relative to the first bearing in a circumferential direction. Thus, when the crankshaft is disposed to be inclined as described above, a gap at the second bearing is further reduced or increased more than that at the first bearing. Accordingly, when a gap between a bearing surface and an outer surface of the crankshaft in the first bearing is G1 and a gap between a bearing surface and an outer surface of the crankshaft in the second bearing is G2, the compressor satisfies the relation of $G1<G2$, thereby allowing the normal clearance to be maintained in the second bearing.

Figure 4:
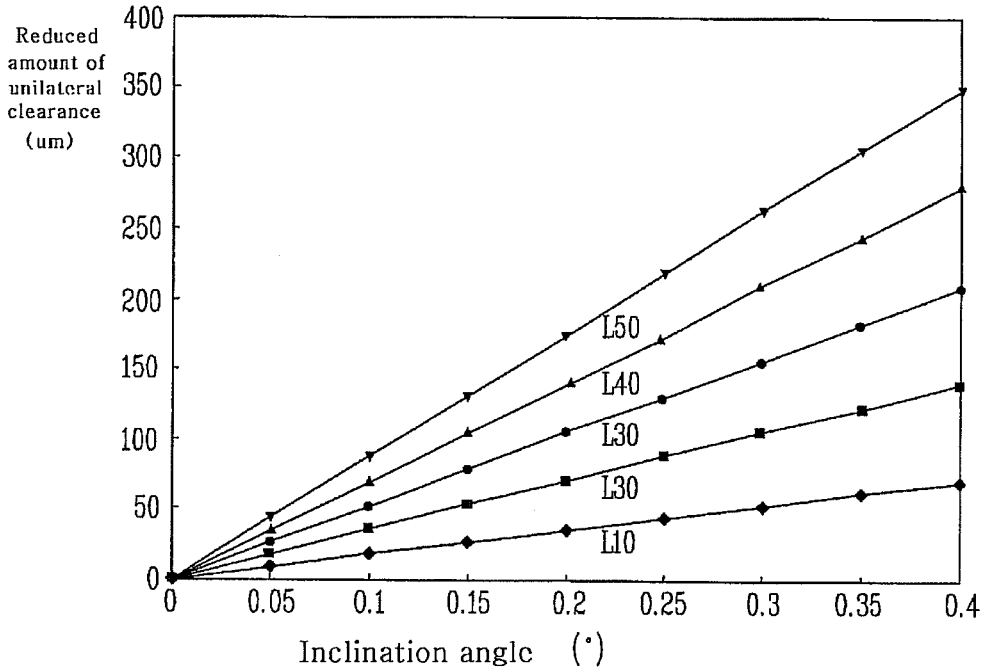
FIG. 4 is a graph showing an example of clearance reduction that may be realized in relation to a length of the second bearing.

FIG. 4 is a graph showing an example of a reduced amount of clearance according to a length of the bearing bush, and specifically a reduced amount of unilateral clearance according to an inclination angle in a case where the length (L) of the bearing bush is 10, 20, 30, 40, and 50 μm, respectively. Referring to FIG. 4, in case of the same inclination angle, it is seen that the reduced amount of unilateral clearance is increases linearly as the length (L) of the bearing bush increases.

Figure 5:
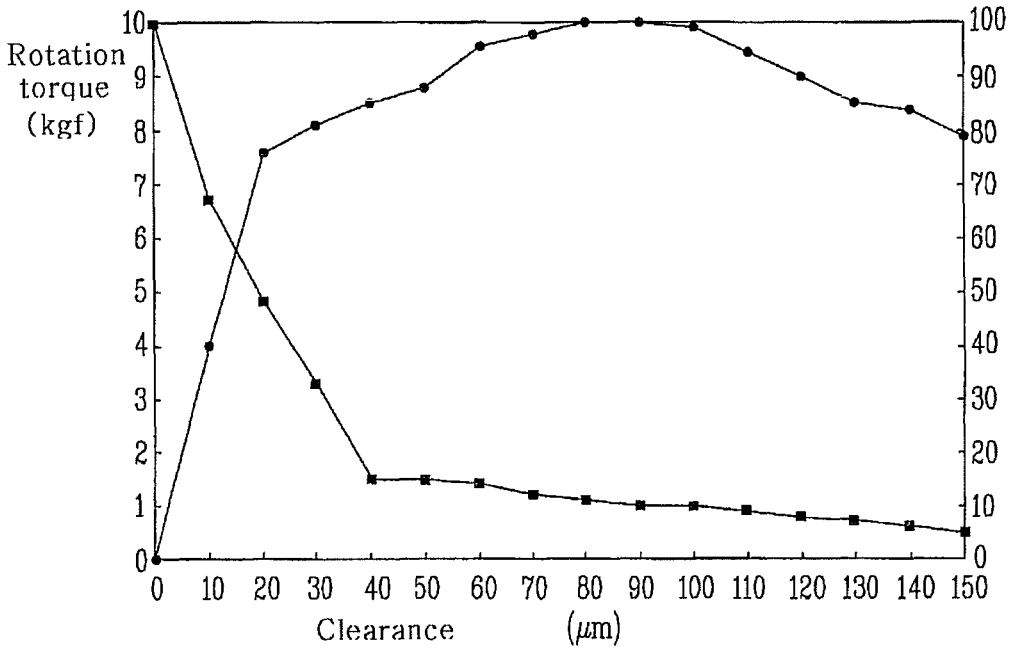
FIG. 5 is a graph showing an example of a change of rotational torque and performance in relation to a clearance in the second bearing.

The present inventors tested a change of the rotation torque and performance according to the clearance (D−d) when the diameter of the crankshaft is 10 mm, and the length of the bearing bush is 10 mm by taking such points into account, and the result is illustrated in FIG. 5. Here, the rotation torque is a torque required to rotate the crankshaft in a state that external force is not applied thereto, and preferably it is small, and the performance implies a ratio of the actually measured performance to the theoretically measured performance, and preferably it is large.

Referring to FIG. 5, the rotational torque decreases as clearance increases. However, it is seen that at 40 μm in this example, the rotational torque is drastically reduced according to an increase of clearance prior to the reference value, but not so much reduced even when the clearance increases at a point after the reference value.

On the other hand, the clearance should be increased in proportion to a diameter (d) of the crankshaft and a length (L) of the bearing bush. In other words, even when the crankshaft is inclined at the same inclination angle, a reduced amount of the preset clearance is increased as increasing the diameter of the crankshaft or the length of the bearing bush, and thus an optimal clearance should be set by taking the diameter of the crankshaft or the length of the bearing bush into account.

In the above example, 1/1000 of the diameter of the crankshaft, i.e., 10 μm, is an optimal clearance in a state that the crankshaft is not inclined. But, the result illustrated in FIG. 5 shows that a clearance between 60 μm and 100 μm is optimal. Thus, it is seen that the clearance should be increased up to the minimum 50 μm and maximum 90 μm from the optimal clearance. In other words, that 50 μm+d/1000<D−d<90 μm+d/1000.

One or more embodiments described herein, therefore, provide a hermetic compressor capable of minimizing or reducing friction loss. In accordance with one embodiment, the hermetic compressor includes a hermetic container; a rotation drive unit provided at an inner space of the hermetic container; a rotation shaft combined with the rotation drive unit; a compression mechanism combined with the rotation shaft to inhale and compress refrigerant; a first bearing fixed to the compression mechanism to support the rotation shaft; and a second bearing fixed to the hermetic container to support an end portion located apart from the first bearing on the rotation shaft.

When an inner diameter of the second bearing is D (μm), a diameter of the rotation shaft is d (μm), and a normal clearance between the second bearing and the rotation shaft is C0 in case where the rotation shaft is vertically located at an inner portion of the second bearing, the compressor satisfies the relation of C0<D−d<90 μm+d/1000.

According to one aspect, a larger clearance may be provided compared to a case where the rotation shaft is vertically located by taking a dimension of each constituent element as well as a slope of the rotation shaft into consideration when configuring a clearance between the second bearing and the rotation shaft. In other words, when a clearance (hereinafter, normal clearance) configured in case where the rotation shaft is located in parallel to a contact surface of the bearing within the bearing is C0, in the related art, the clearance has been determined without considering the slope of the rotation shaft.

However, as a result of the studies of the present inventors, it was confirmed that the clearance may be reduced or increased due to a slope of the rotation shaft as increasing the length of the rotation shaft even when an inner diameter of the bearing and a diameter of the rotation shaft are precisely processed in the bearing located at the upper portion.

If the clearance is reduced as described above, it may cause a problem that hydrodynamic lubrication cannot be carried out between the bearing and the rotation shaft, and only boundary lubrication is carried out, the rotation shaft is directly brought into contact with a surface of the bearing, or the like. Accordingly, it may be required to configure a clearance between the two elements larger than the normal clearance in order to be prepared for the case of inclination of the rotation shaft.

Nevertheless, when excessively increasing the clearance, there may exist a case in which the rotation shaft is not inclined as well as a case where the bearing cannot perform the role, and thus the upper limit is set to a value in which 90 μm is added to 1/1000 of the diameter of the rotation shaft.

On the other hand, a difference between the D−d value and the C0 may be set proportional to a thickness (L) of the second bearing. In other words, a reduced amount of the clearance may be increased as increasing the thickness of the bearing even when the rotation shaft has the same inclination. Taking this into account, a difference between the D−d value and the C0 may be increased as increasing the thickness of the bearing. On the other hand, the normal clearance (C0) may be set to 1/1000 of the diameter of the rotation shaft.

Furthermore, the second bearing may include a frame combined with an inner circumferential surface of the hermetic container; a housing combined with the frame to be rotatably combined with the rotation shaft; and a bearing bush provided at an inner portion of the housing to face the rotation shaft, wherein the bearing bush is located to be protruded downward from the housing. Through this, it may be possible to decrease a reduced amount of the clearance by the inclination of the rotation shaft by reducing a gap between the first bearing and the second bearing while maintaining a sufficient gap between the frame for fixing the second bearing and the rotation drive unit.

Here, the frame and housing may be individually produced and assembled or integrally formed. Specifically, the housing may include a bearing protrusion formed to be protruded in a downward direction of the hermetic container, wherein the bearing bush is mounted at an inner portion of the bearing protrusion.

Here, the thickness (L) of the second bearing may be a thickness of the bearing bush. Furthermore, it may be configured such that the D−d value is located between 50 μm+d/1000 and 90 μm+d/1000.

According one embodiment, the rotation shaft may be disposed to be inclined to maintain the clearance within an optimal range, thereby minimizing the performance deterioration of the compressor due to friction loss.

In accordance with another embodiment, compressor, comprises a hermetic container; a rotation driver in the container; a rotational shaft coupled to the rotation driver; a compression mechanism, coupled to the shaft, to inhale and compress refrigerant; a first bearing to support the shaft; and a second bearing fixed to the container to support the shaft. The first and second bearings are separated by a predetermined distance, and the following relation is satisfied:

$$C_0<D-d<90\ \mu m+d/1000$$

where D is an inner diameter of the second bearing, d is a diameter of the shaft, and $C_0$ is a clearance between the second bearing and the shaft when the shaft is oriented substantially vertically relative to an inner portion of the second bearing.

A difference between a value corresponding to D−d and C0 may be proportional to a thickness (L) of the second bearing.

The second bearing may include a frame adjacent an inner circumferential surface of the container; a housing adjacent the frame and rotatably combined with the shaft; and a bearing bush at an inner portion of the housing to face the shaft and extending downward from the housing. The thickness L of the second bearing may correspond to a thickness of a bearing bush, and the frame and housing may be integrally formed.

The housing may include a bearing protrusion that extends downward relative to the container, wherein the bearing bush is mounted at an inner portion of the bearing protrusion. In addition, the following relation is satisfied: 50 μm+d/1000<D−d<90 μm+d/1000.

In accordance with another embodiment, a compressor comprises a hermetic container; a rotational driver in the container; a rotational shaft coupled to the rotation driver; a compression mechanism, coupled to the shaft, to inhale and compress refrigerant; a first bearing to support the shaft; and a second bearing to support the shaft, wherein the first and second bearings are separated by a predetermined distance and G1<G2, where G1 is a gap between an outer surface of the shaft and a surface of the first bearing and G2 is a gap between the outer surface of the shaft and a surface of the second bearing.

The following relation may be satisfied: G1<D−d<90 μm+d/1000, where D corresponds to an inner diameter of the second bearing and d corresponds to a diameter of the shaft.

The following relation may be satisfied: 50 μm+d/1000<D−d<90 μm+d/1000, where D corresponds to an inner diameter of the second bearing and d corresponds to a diameter of the shaft.

In accordance with another embodiment, a compressor, comprises a rotational shaft; a compression mechanism coupled to the shaft; a first bearing to support the shaft; and a second bearing to support the shaft, wherein the first and second bearings are arranged at different locations relative to the shaft, and wherein a first clearance between the shaft and the first bearing is set to control a second clearance between the shaft and the second bearing, the first clearance set to cause the second clearance to have a value which falls within a predetermined range from the second bearing.

The predetermined range may not include a zero value where the shaft makes contact with the second bearing, and the shaft may be tilted at an angle which causes the first clearance to be different from the second clearance.

The following relation may be satisfied: C0<D−d<90 μm+d/1000, where D is an inner diameter of the second bearing, d is a diameter of the shaft, and C0 is the second clearance when the shaft is oriented substantially vertically relative to an inner portion of the second bearing. The first clearance may be set based on a length of an inner surface of the second bearing facing the shaft.

The following relation may be satisfied: 50 μm+d/1000<D−d<90 μm+d/1000, where D is an inner diameter of the second bearing and d is a diameter of the shaft.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of one embodiment may be combined with the features of one or more of the other embodiments.

Although embodiments have been described with reference to a number of illustrative embodiments, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a hermetic container;

a rotation driver in the container;

a rotational shaft coupled to the rotation driver;

a compression mechanism, coupled to the shaft, to inhale and compress refrigerant;

a first bearing to support the shaft; and a second bearing fixed to the container to support the shaft, wherein the first and second bearings are separated by a predetermined distance, wherein the following relation is satisfied to reduce friction loss between the second bearing and the shaft and to maintain bearing function between the second bearing and the shaft:

$$50\ \mu m + d/1000 < D - d < 90\ \mu m + d/1000$$

where D is an inner diameter of the second bearing, and d is a diameter of the shaft, and wherein the second bearing includes:

a frame adjacent to an inner circumferential surface of the container;

a housing having at least one support protrusion detachably coupled to the frame and a bearing protrusion that protrudes toward the first bearing from the at least one support protrusion; and a bearing bush disposed at an inner portion of the bearing protrusion to face the shaft.

2. The compressor of claim 1, wherein a difference between a value corresponding to D−d and a value of d/1000 is proportional to a thickness L of the second bearing.

3. The compressor of claim 2, wherein the thickness L of the second bearing corresponds to a thickness of the bearing bush.

4. The compressor of claim 1, wherein the at least one support protrusion extends in a direction perpendicular to an axial direction of the rotational shaft.

5. A compressor, comprising:

a hermetic container;

a rotational driver in the container;

a rotational shaft coupled to the rotation driver;

a compression mechanism, coupled to the shaft, to inhale and compress refrigerant;

a first bearing to support the shaft; and a second bearing to support the shaft, wherein the first and second bearings are separated by a predetermined distance and G1<G2, where G1 is a gap between an outer surface of the shaft and a surface of the first bearing and G2 is a gap between the outer surface of the shaft and a surface of the second bearing, wherein the following relation is satisfied to reduce friction loss between the second bearing and the shaft and to maintain bearing function between the second bearing and the shaft:

$$50\ \mu m + d/1000 < D - d < 90\ \mu m + d/1000$$

where D corresponds to an inner diameter of the second bearing and d corresponds to a diameter of the shaft, and wherein the second bearing includes:

a frame adjacent to an inner circumferential surface of the container;

a housing having at least support protrusion detachably coupled to the frame and a bearing protrusion that protrudes toward the first bearing from the at least one support protrusion; and a bearing bush disposed at an inner portion of the bearing protrusion to face the shaft.

6. A compressor, comprising;

a rotational shaft;

a compression mechanism coupled to the shaft;

a first bearing to support the shaft; and a second bearing to support the shaft, wherein a first and second bearings are arranged at different locations relative to the shaft, wherein a first clearance between the shaft and the first bearing is set to control a second clearance between the shaft and the second bearing, the first clearance being set to cause the second clearance to have a value within a predetermined range, wherein the following relation is satisfied to reduce friction loss between the second bearing and the shaft and to maintain bearing function between the second bearing and the shaft:

$$50\ \mu m + d/1000 < D - d < 90\ \mu m + d/1000$$

where D is an inner diameter of the second bearing and d is a diameter of the shaft, and wherein the second bearing includes:

a frame adjacent to an inner circumferential surface of the container;

a housing having at least one support protrusion detachably coupled to the frame and a bearing protrusion that protrudes toward the first bearing from the at least one support protrusion and a bearing bush disposed at an inner portion of the bearing protrusion to face shaft.

7. The compressor of claim 6, wherein the predetermined range does not include a zero value where the shaft makes contact with the second bearing.

8. The compressor of claim 6, wherein the shaft is tilted at an angle, said angle causing the first clearance to be different from the second clearance.

9. The compressor of claim 6, wherein the first clearance is set based on a length of an inner surface of the second bearing facing the shaft.

* * * * *